United States Patent [19]

Villa

[11] 4,268,995

[45] May 26, 1981

[54] WINDOW FRAMES HAVING SWINGABLE BLIND-SLATS

[76] Inventor: Genesio Villa, Via Ariosto 215, Sesto San Giovanni (Milan), Italy

[21] Appl. No.: 28,882

[22] Filed: Apr. 10, 1979

[30] Foreign Application Priority Data

Apr. 13, 1978 [IT] Italy ..... 22290 A/78

[51] Int. Cl.[3] ..... E06B 7/086

[52] U.S. Cl. ..... 49/87; 49/90; 49/388; 49/403; 98/121 A

[58] Field of Search ..... 49/88, 87, 90, 403, 49/91, 371, 388; 98/121 A

[56] References Cited

U.S. PATENT DOCUMENTS

| | | | |
|---|---|---|---|
| 2,830,335 | 4/1958 | Miller | 49/388 X |
| 2,890,503 | 6/1959 | Paine | 49/91 X |
| 3,188,074 | 6/1965 | Revitz et al. | 49/87 |
| 3,189,339 | 6/1965 | Siciliano | 49/87 |
| 3,296,740 | 1/1967 | Sconzo | 49/87 |
| 3,706,165 | 12/1972 | Baldrich | 49/91 X |
| 3,750,336 | 8/1973 | Johnson | 49/403 X |
| 3,783,768 | 1/1974 | Caming et al. | 98/121 A X |

FOREIGN PATENT DOCUMENTS

| | | | |
|---|---|---|---|
| 160397 | 1/1955 | Australia | 49/403 |
| 220149 | 3/1942 | Sweden | 49/87 |

*Primary Examiner*—Philip C. Kannan
*Attorney, Agent, or Firm*—Charles E. Brown

[57] ABSTRACT

A window frame, especially for ventilation by setting at various angles a plurality of slats mounted on said frame is disclosed, the improvement consisting in that the control lever which acts upon the rod which gangs the slats for setting them at an angle together has the end pointing towards the interior of the frame in the form of a scalloped sector, the points of which engage, in turn, a notch formed on a brace which is removably fastened to the window frame upright. The mechanism is reliable and versatile since it permits that the slats may be set at various angles in a stable manner. Means are also provided for preventing slat rattle by properly shaping the individual frames of the slat carriers. Thermoplastics materials are widely used in the construction of the frame and accessories.

24 Claims, 17 Drawing Figures

WINDOW FRAMES HAVING SWINGABLE BLIND-SLATS

Frames are known, such as window frames, glass wall frames and the like, which comprise a set of manually swingable slats which can be set at various angles so as to provide the correct ventilation to a room.

Such slats, made of glass or a plastics material, are mounted within end guides, these latter being pivoted at their middle point to the window frame, which is generally made of a metal section.

The swing of the slats is controlled manually by a lever which acts upon a pantograph-type linkage: the linkage is placed on the inner side of the frame.

A control system of this kind, though it affords the advantage of a quick action, originates certain drawbacks which are a result both of the structural arrangement and the fact that the pantograph linkage is completely enclosed within the frame, from which only the manipulating lever protrudes.

A first drawback is due to the fact that the slats can be swung only between a closure end position and a wide open end position: as a matter of fact, non intermediate positions are provided, in which the slats can stably be set, as would be desirable for adjusting the ventilation of the room to a desirable level.

Another shortcoming is the pantograph linkage, the pivots of which, generally rivets, are all internal to the window frame. It can thus be readily understood that, if a rivet is broken, it is required that the entire frame be overhauled for replacing the broken piece.

A further drawback is caused by the slat-carriers, which are U-shaped sections with detent teeth at the ends and into which the slats are freely slipped: the fit is thus too loose due to dimensional tolerances and this originates slat rattle, which is obviously an inconvenience.

Swingable-slat frames are also known, which are equipped with a control system placed externally of the window frame and in which the slat-carriers are connected on either side, by a rod which is controlled by a nut and screw type control having a manual control handle.

It is obvious that mechanisms of this kind provide a fine adjustment of the slat positions but this can be achieved only by a patient manipulation of the handle: thus, when such an adjustment must be carried out for a large number of windows, a control device of the kind referred to above requires a too inconvenient and time-consuming operation. There is the advantage, however, that the mechanism is outside the frame and thus conveniently accessible when required.

The general object of this invention is to provide a swingable-slat frame having the advantages of an easy manipulation concurrently with the possibility of adjusting the slats at various angles, like the mechanisms of known type mentioned above, but without the defects enumerated above.

An object of the present invention is thus to provide a swingable-slat window frame equipped with a control mechanism by which the slats can be set at any of a plurality of preselected positions between the shut and the fully open position.

Another object of the present invention is to provide a swingable-slat frame equipped with a control mechanisms which can be installed easily and rapidly outside the frame, so that it can be readily accessed to and/or withdrawn, for replacement or repair.

Yet another object of the present invention is to provide a swingable-slat mechanism in which the slat carriers are equipped with means adapted to take up dimensional tolerances in the slats.

Still another object of the present invention is to provide a swingable slat frame in which the articulated linkage for its control is equipped with pivots which can conveniently be installed and withdrawn.

An additional object of the present invention is to provide a slat carrier equipped with means of positive latching which is capable of preventing a slat from slipping out when subjected to intense thrusting forces directed parallely to the slat plane.

A supplemental object of the present invention is to provide a slat carrier equipped with positive latching means for the slats, so as to allow that the slat may be placed in position and removed both simply and quickly.

Having these objects in view, according to the invention, it has been envisaged to provide a swingable slat window frame of the kind in which the slat carriers pivoted at a middle point to the window frame are interconnected by a rod parallel to the appropriate side of the frame and pivotally connected to said carriers at one end thereof, characterized in that a control lever is mounted on said rod by the intermediary of a connecting rod having either end pivoted to said rod and the opposite end pivoted at an intermediate point of the control lever, means being provided between said lever and said frame side for a snapping latching engagement with each other at a plurality of stable positions.

According to a possible embodiment of the invention, said means of mutual snapping engagement between the lever and the window frame consist of at least one crenellated sector provided at either end of said control lever, the teeth of said sector engaging a corresponding resiliently yielding seat which is integral with a brace removably fastened to the window frame and to which said lever is pivoted in correspondence with said crenellated sector.

A slat carrier for swingable slats of windows according to the present invention comprises a channel profile of a plastics material at the ends of which a web is extended with a portion beyond the opposite web so as to define staggered portions at opposite ends of the channel section, through which the slat can be inserted by exploiting the resilient yield of such portions: in addition, these latter have an end tooth bent through 90° for retaining the slat, at least either tooth having a removable anchoring means for a pitman extending from the body of the profile.

It is thus apparent that such a pitman prevents the resilient portion from being bent under the thrust of the positioned slat, which is thus positively prevented from slipping out of its seat, unless the pitman is cleared of the tooth and this cannot be an accidental event but can only be caused by an operator who, by intentionally manipulating the pitman, withdraws it from the tooth interspace.

The foregoing and other features and advantages of the invention will become still more clearly apparent from a scrutiny of the ensuing description of a few exemplary embodiments thereof with reference to the accompanying drawings, wherein.

Figure 1:
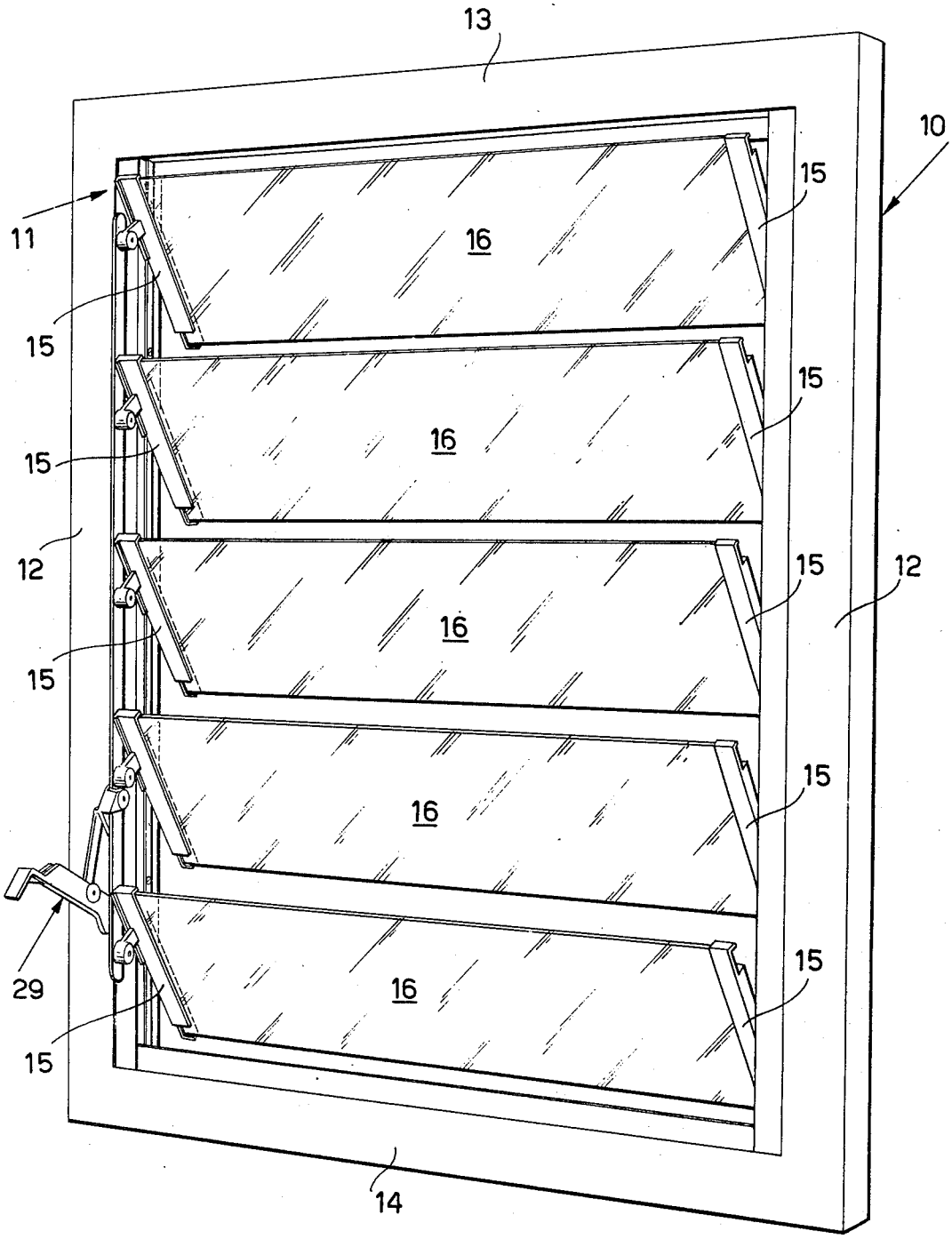
FIG. 1 is a perspective view showing a swingable-slat window arrangement incorporating the control mechanism constructed according to the invention.

In FIG. 1 of the drawings, the numeral 10 generally indicates a swingable-slat window assembly which is structurally composed by an external border 11, to which there is fastened a framing of metallic profiles comprising uprights 12 and top cross-ties 13 and bottom cross ties 14.

On the uprights 12 are pivoted slat carriers 15 into which slats 16, of glass or a plastics material, are inserted.

The slat carriers 15 are formed by a U-, or channel profile of plastics material 17, at the ends of which a web extends with a portion 18 beyond the opposite web, said portion having a detent tooth 19, at 90°. Portions 18 are thus defined, which are staggered at the opposite ends of the channel profile and through which the slats can be inserted into the slat carrier by exploiting the resilient yield of such portion 18. The teeth as 19 tender a stop against the free sliding of the slats 16.

Possible dimensional tolerances for the slats, in order that undesirable slat rattle may be prevented, are taken up by resiliently yielding tongues 20 which extend integrally from the channel section and are stamped in the core 21.

Figure 10:
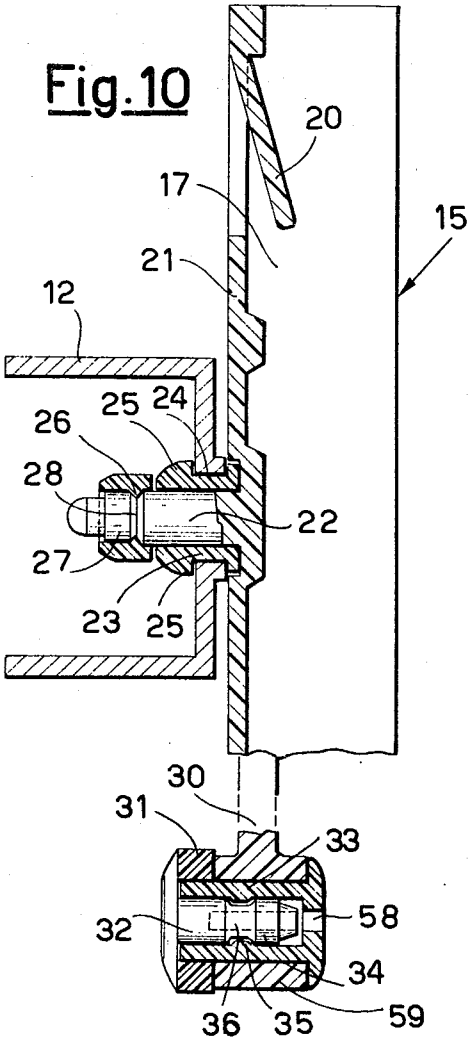
FIG. 10 is a cross-sectional view taken along the line X—X of FIG. 4.
Figure 11:
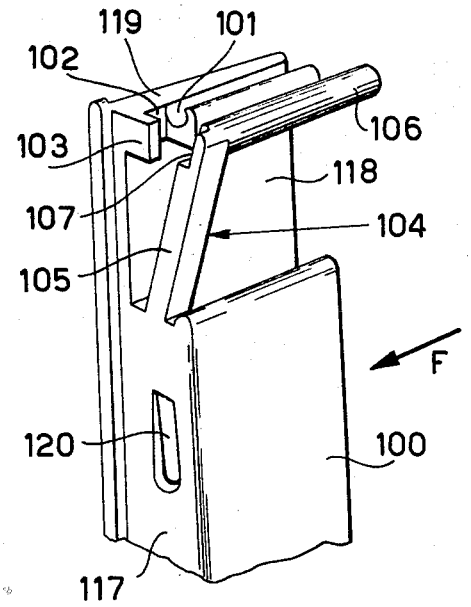
FIG. 11 is a perspective view showing partially a slat carrier made according to an alternative embodiment of the invention.
Figure 12:
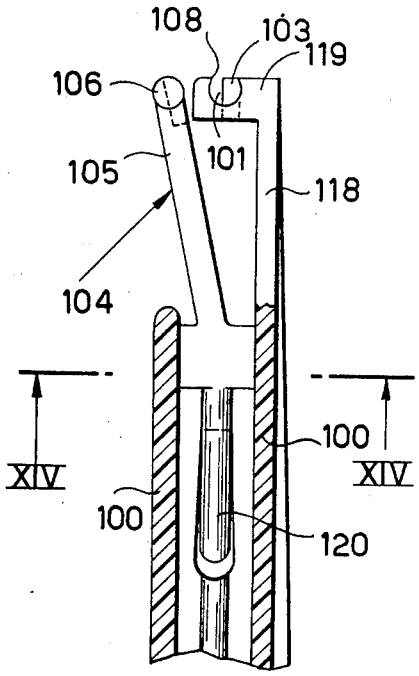
FIG. 12 is a view taken along the arrow F of FIG. 11, partly in cross-sectional view.
Figure 13:
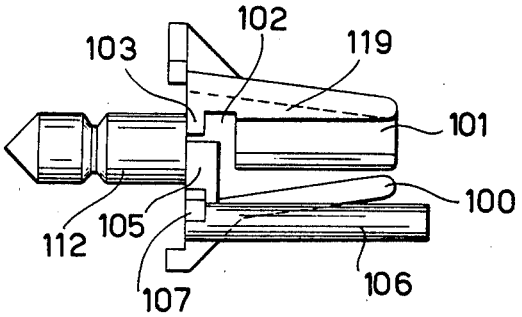
FIG. 13 is a top plan view.

The slat carriers 15 are pivoted to the uprights 12 at an intermediate point by a pivot 22 (FIG. 10) formed integrally in the core of the channel section and snappingly engaged by a plastics material bushing 23, the latter being coupled to the upright 12. The bushing 23 is snappingly engaged in a corresponding bore 24 of the upright 12 by a couple of resiliently yieldable detent teeth 25, which are diametrically opposite. The bushing has, internally provided, an annular rib 26, past which a rib 27 of the pin 22 snaps, whereafter the rib 26 can be seated in an annular groove 28 of the pin 22.

The slat carriers 15, on the side of the control mechanism (generally indicated at 29), have, additionally, an arm 30 for the articulated linking of all the slat carriers by a manipulating rod 31. The pivotal connection between the rod 31 and the arms 30 takes place by means of a hub 59 (FIG. 10) at the end of the arm 30: this arm is connected to the rod 31 by the snapping coupling of a pin 32 with a bushing 33.

To this latter purpose, the pin 32 has an annular rib 34 which snaps past an annular rib 35 of the bushing 33: the latter rib is seated in an annular groove 36 of the pin 32.

The translational motior of the rod 31 and thus the slat swing, is manually controlled by a lever 37, U-shaped, which is connected by a connecting rod, 38, to the rod 31.

Figure 8:
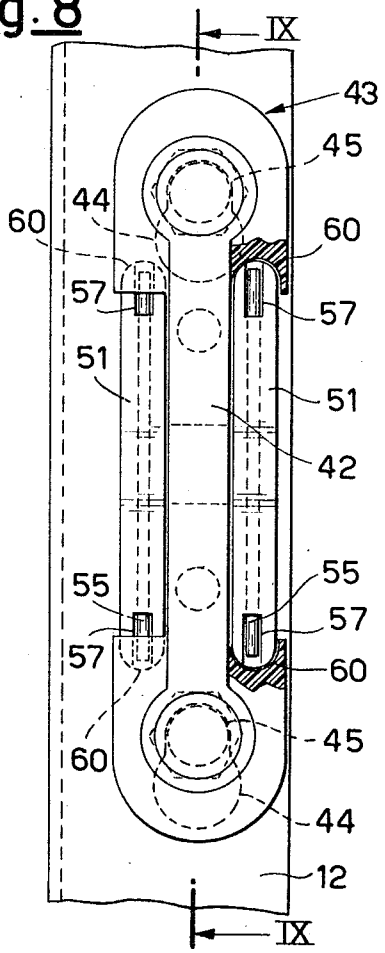
FIG. 8 is a detail in elevational view, partly in cross-section, showing the brace for installing the mechanism on the window frame.
Figure 9:
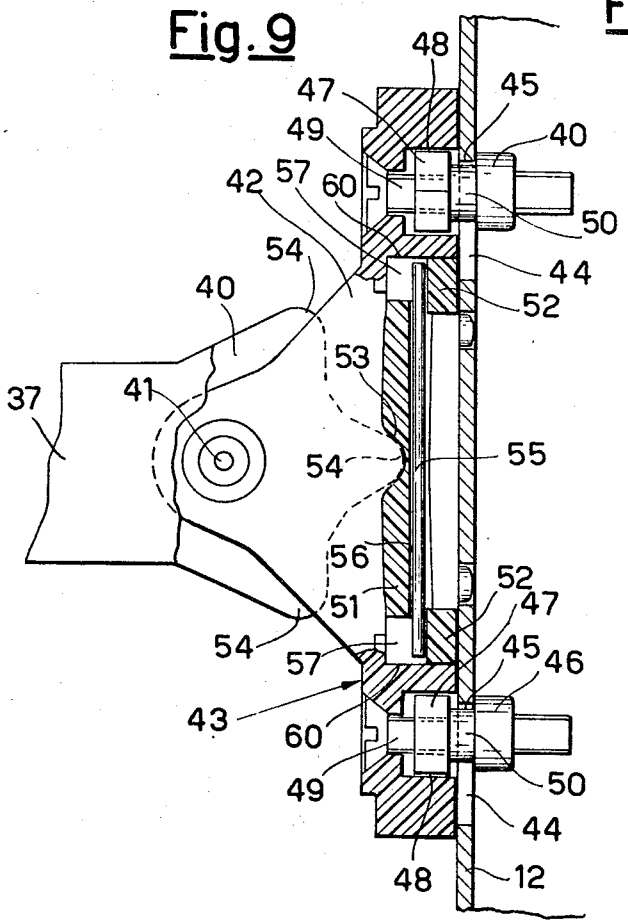
FIG. 9 is a cross-sectional view taken along the line IX—IX of FIG. 8.

The connecting rod 38, by means of a pivotal connection akin to that of the arms 30, is pivoted, at a forked end 39, to the rod 31, and, at the opposite end, to an intermediate point of the lever 37. Lever 37 is further pivoted, at a forked end 40, at a point 41, to an ear 42 of a brace 43 removably fastened to the upright 12 (FIGS. 8 and 9). The brace 43 is mounted on the upright 12 by a sort of bayonet coupling comprising two spaced apart couples of mutually communicating slots 44, 45 having a larger diameter and a smaller diameter, respectively, formed through the upright 12. In the slot 44 can be inserted a stalk 46 which extends integrally from a nut 47 housed in a corresponding seat 48 of the brace 43 in such a way that rotation of 47 be prevented, a specially provided screw 49 holding the nut 47 in position.

By this provision, the brace 43 can be fastened to the upright 12 by first inserting the stalks 46 into the respective slots 44 and shifting thr brace 43 upwards so as to bring an annular groove 50 of the stalks 46 to engage the edges of the lesser-diameter slot 45.

It is thus apparent that the brace cannot be withdrawn and the latter is secured in position by tightening the screws 49.

The brace 43 has, laterally of the ear 42, two ties 51, which are resiliently yieldable and rest freely at their ends upon the upright 12 by means of blocks 52, and are housed in respective recesses 60 formed through the brace 43. At the center of each tie 51 there is provided a seat or a notch 53, into which the teeth 54, of crenellated sectors formed at the end of the lever 37 in correspondence with the pivotal connection to the ear 42, can snap.

The ties 51, as well as the lever 37, are made of a thermo-plastics material and are reinforced, in order to afford them the required robustness and resiliency, by a piano wire 55 which is housed within a groove 56 and is inserted through bores 57 formed in correspondence with the blocks 52.

The operation of the device described hereinabove, is in summary, the following.

Figure 2:
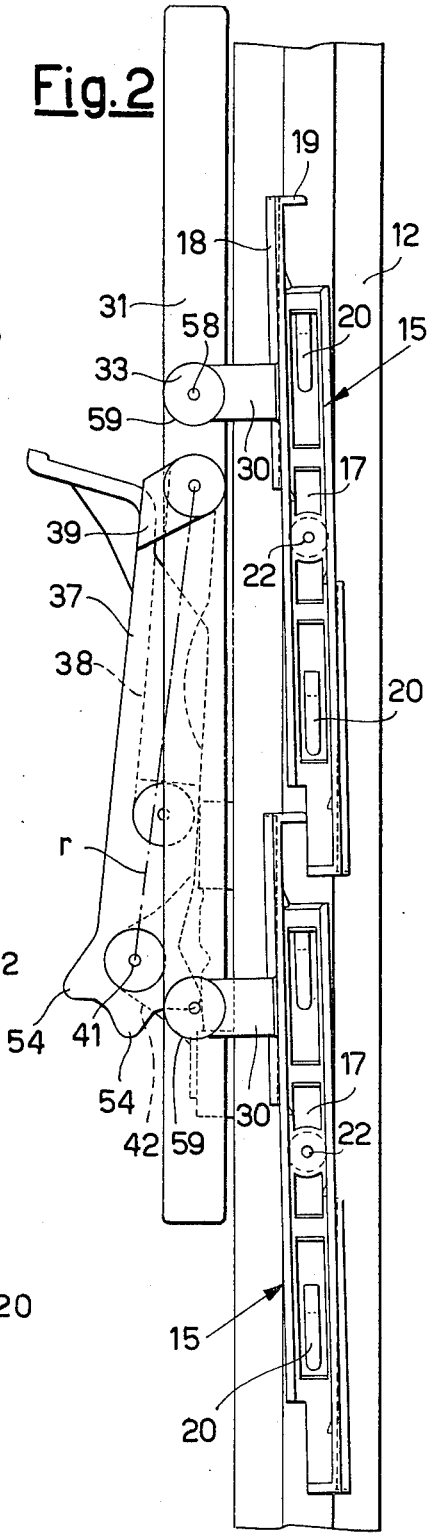
FIG. 2 is a detail in elevational view showing the control device in the shut slat position.

FIG. 2 shows the control device in the shut slat position in which the forcible opening of the slats from outside is prevented by a slight misalignment (towards the interior of the device) of the pivotal point of the connecting rod 38 to the lever 37 relative to the straight line "r" connecting the pivotal points of the connecting rod 38 to the rod 31, and of the lever 37 to the ear 42 of the brace 43. The resilient pressure of the ties 51 against the crenellated sectors of the lever 37 assists in maintaining such a balanced condition of stability of the system.

By rotating the lever 37 anticlockwise about 41, against the bias of the ties 51 against the teeth 54, via the connecting rod 38, the rod 31 is urged to move parallely of the upright 12 and, as a result, the swing of the slat carriers and their attendant slats 16 about the slat carrier pivots 22 takes place via the arms 30.

Figure 3:
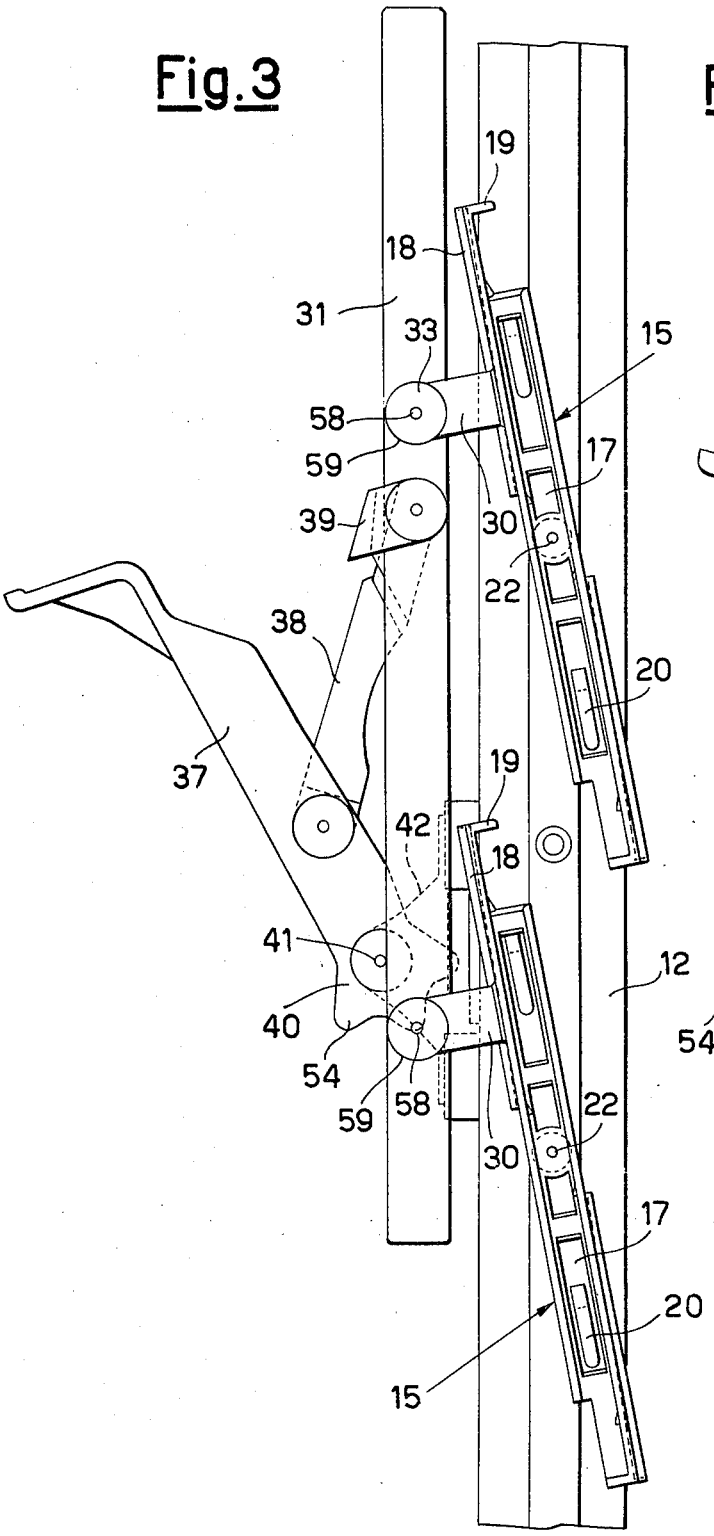
FIGS. 3, 4 and 5 are views like that of FIG. 2 and show the control device in the several angular positions of the slats.
Figure 4:
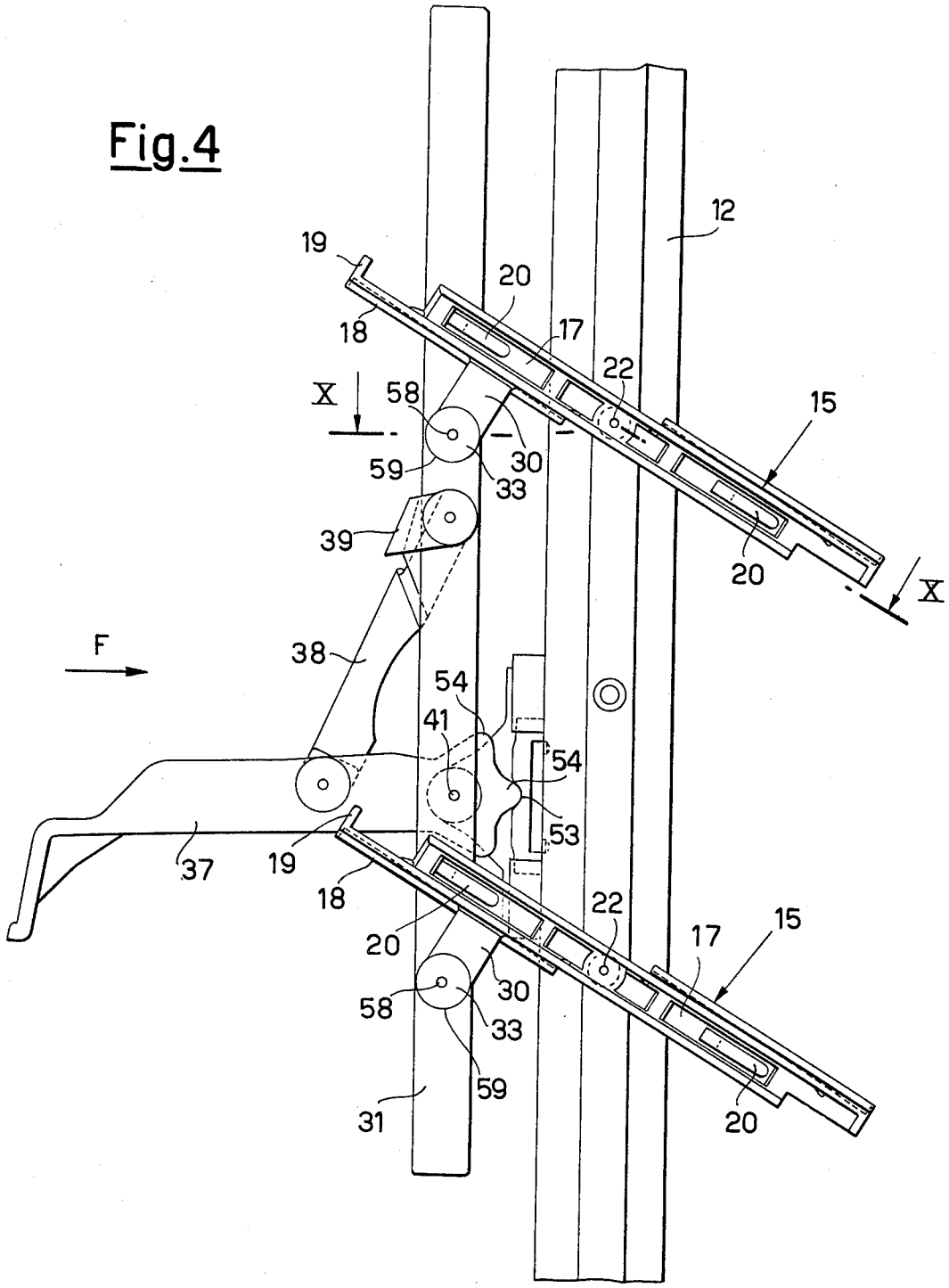
Figure 5:
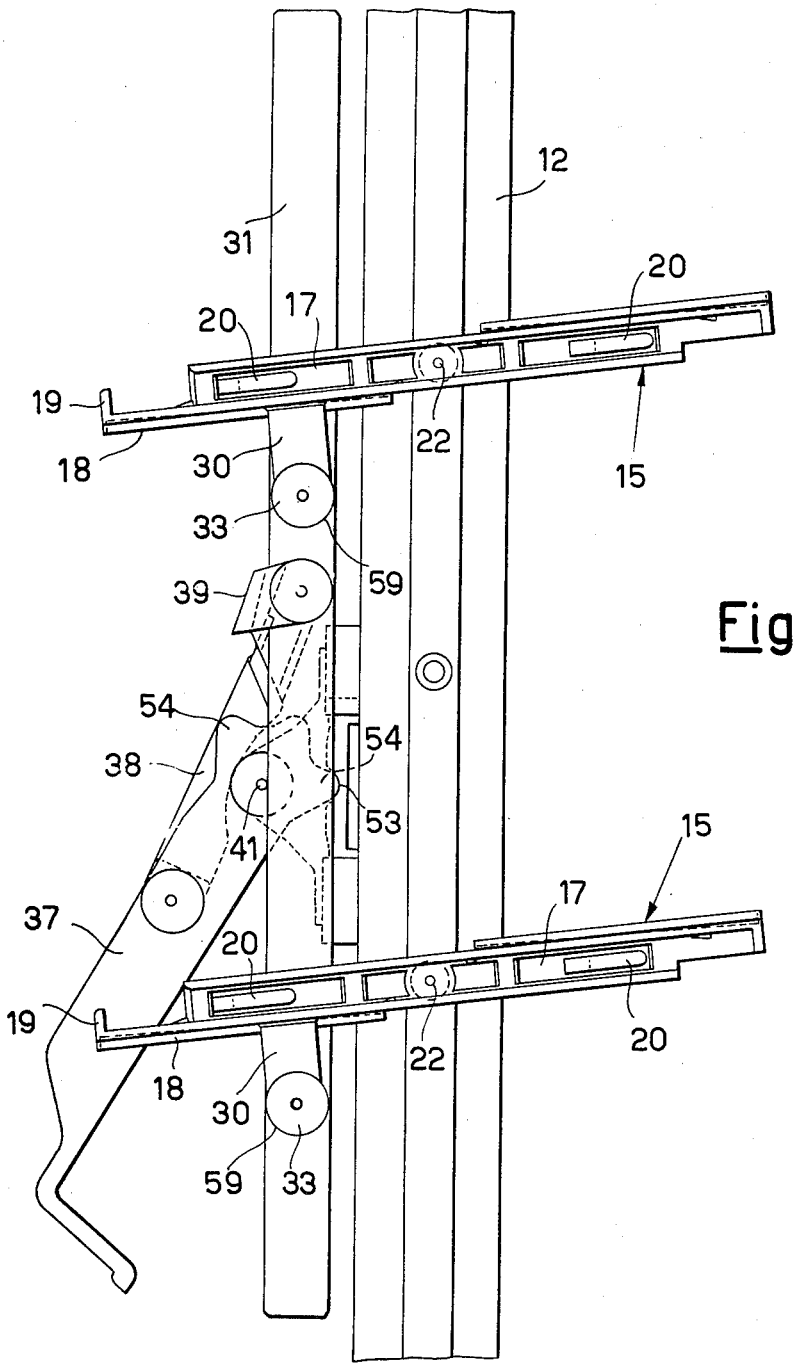
Figure 6:
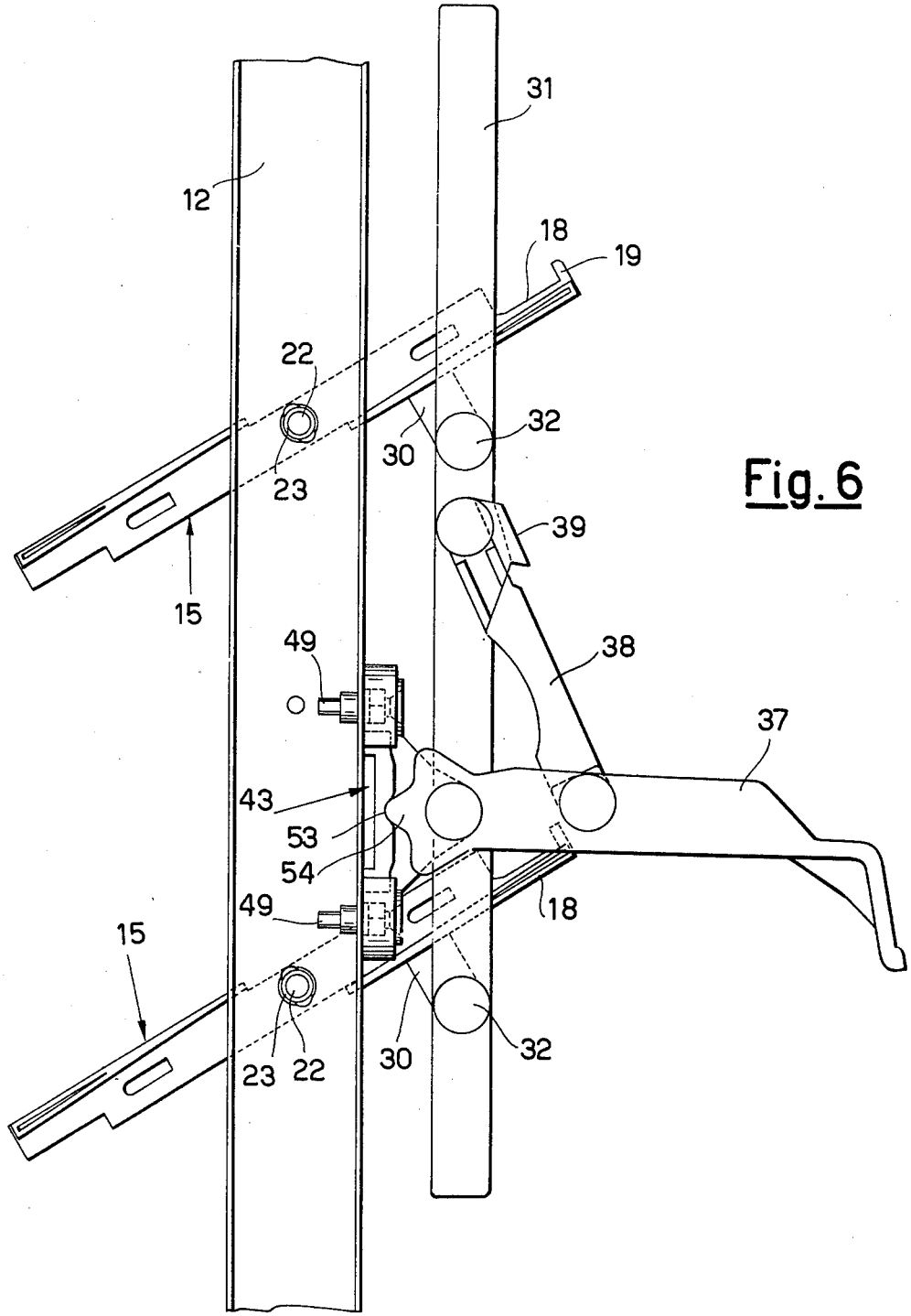
FIG. 6 is a view akin to FIG. 4 but rotated through 180°.
Figure 7:
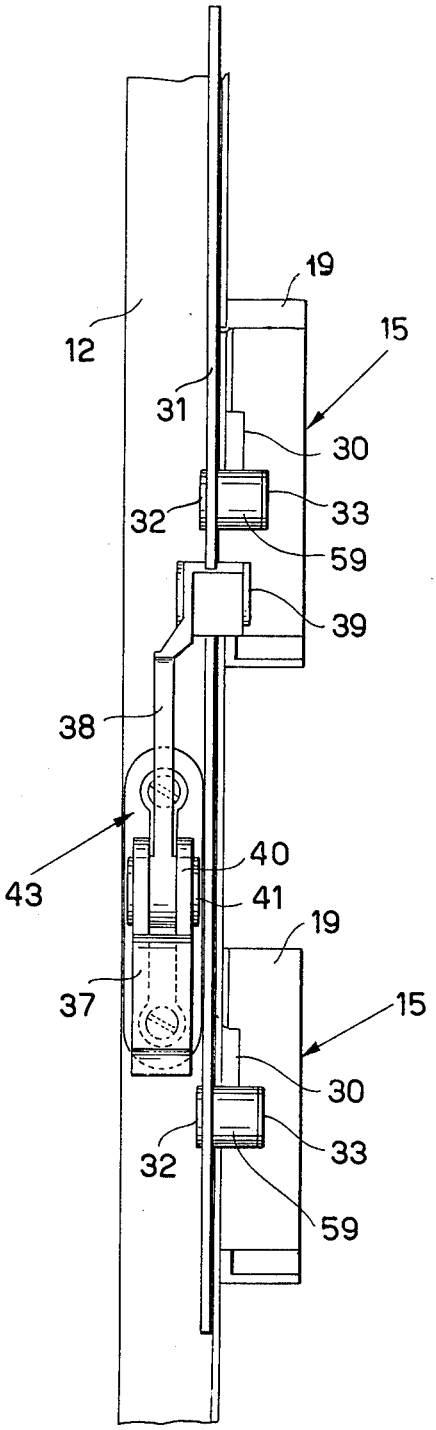
FIG. 7 is an elevational view taken in the direction of the arrow F of FIG. 4.

The stable positive latching of the slats 16 in the desired angular setting is achieved by the snapping engagement of the teeth 54 into the notches 53 of the resilient ties 51. The different angular settings of the slats, corresponding to a more or less active ventilation, are clearly shown in FIGS. 3, 4 and 5 of the accompanying drawings. Thus, FIG. 3 shows the slats in a narrow gap position, FIG. 4 in an intermediate position, and FIG. 5 in the wide open position.

It is thus apparent that the objects recited in the introductory portion of this specification have been achieved, that is to say, to provide a device in which the slats can be latched with a simple and quick manipulation and in a positive manner in any preselected angular setting, the mechanism being dismemberable easily in any of its component part without affecting in any manner the window frame. As a matter of fact, whenever it becomes necessary, the brace 43 can be removed from the upright 12 by merely loosening the screws 49, sliding the brace 43 down and pulling the stalk 46 out through the slots 45. Likewise, the pins 22 can be removed from their bushings 23 by manually pulling the slat carriers. The pin 32, conversely, can be separated from the bushing 33 by pushing it by a punch to be introduced through an axial bore 58 of the bushing 33.

Figure 14:
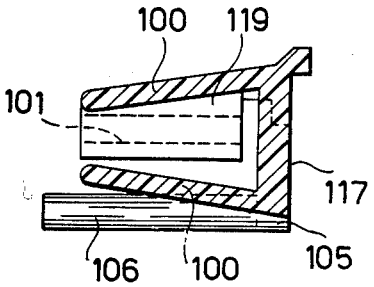
FIG. 14 is a cross-sectional view taken along the line XIV—XIV of FIG. 12.

FIGS. from 11 to 17 inclusive show a slat carrier which is especially adapted to the frame in question. It has been generally indicated at 115 and is composed by a supporting member of plastics material having a channel cross-sectional outline made as an entity with the webs 100 converging (FIG. 14).

Each web 100 of the channel section is extended at either end by a portion 118 beyond the opposite web, the latter having an end detent tooth 119, bent through 90° for retaining the slat 116.

According to the present invention, in at least one of the teeth 119 a longitudinal groove 101, having a partially cylindrical form, is formed. The tooth 119, additionally, has a notch 102 which defines a shoulder 103 the function of which will be explained hereinafter.

Into the groove 101 and the notch 102 there can snappingly be engaged a portion of a resiliently yielding pitman, generally indicated at 104: the pitman extends from the body of the profile 117 on a plane which diverges relative to the plane on which the portion 118 lies. Pitman 104 is shaped like a bell-crank level and has two arms 105 and 106 at right angles with respect to one another and these have, in correspondence with the edge, a recess 107.

Figure 15:
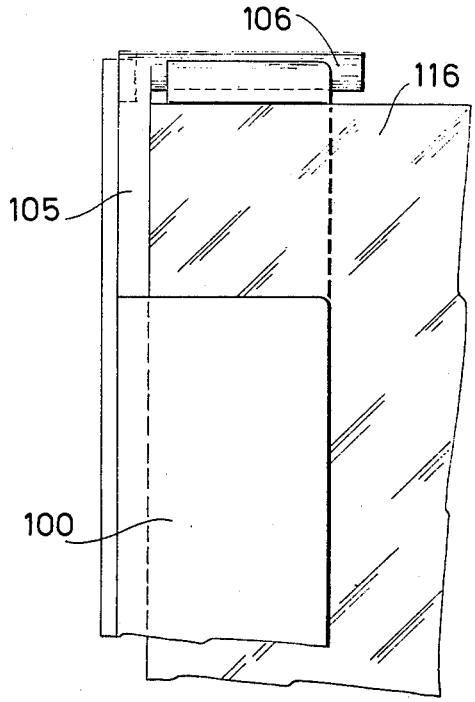
FIG. 15 is an elevational view showing the slat carrier in the position in which the slat is latched.
Figure 17:
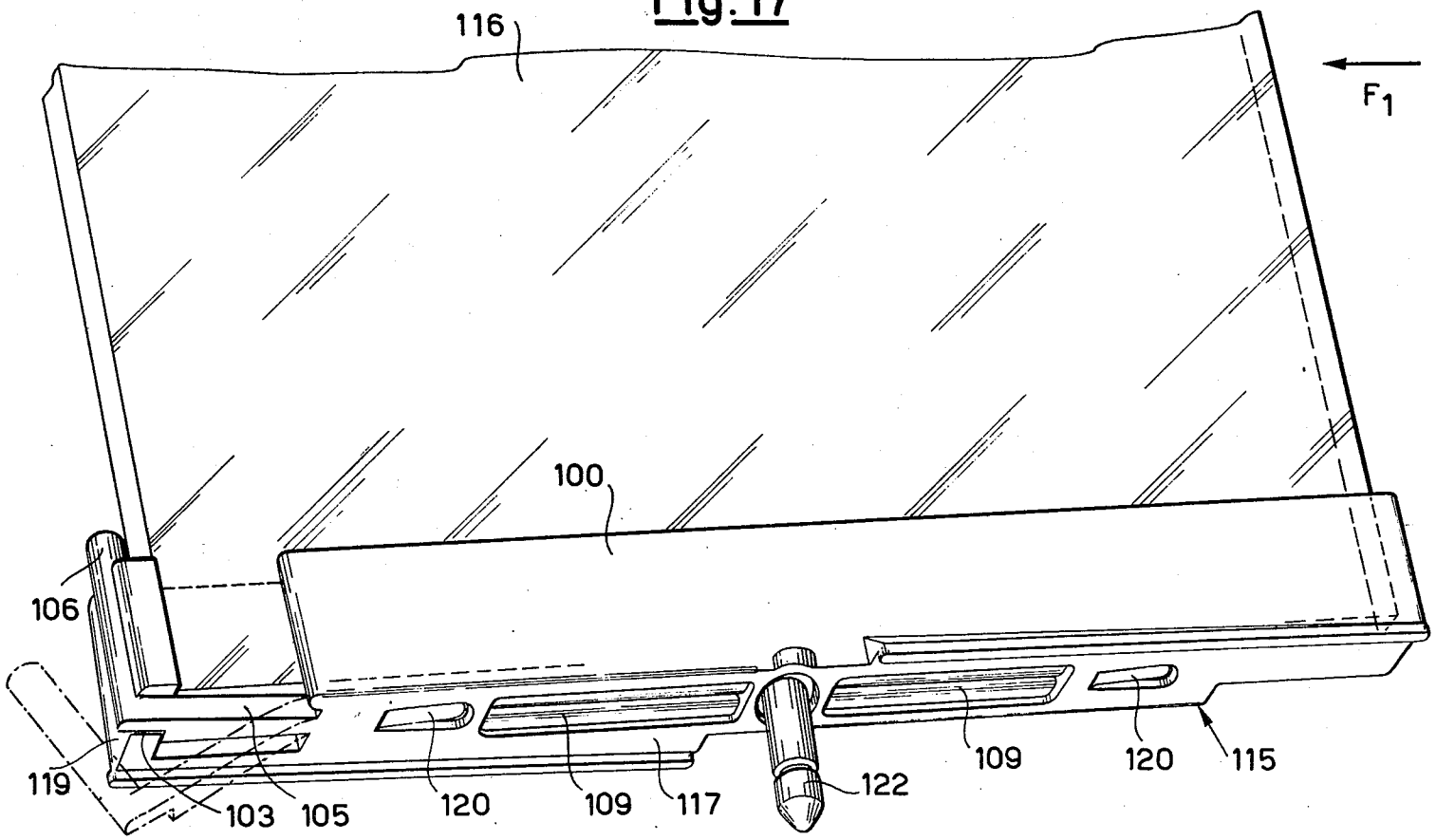
FIG. 17 is a complete perspective view of the slat carrier in its working position.

The slat 116 is mounted in the two slat carriers by exploiting the resiliency of the end portion 118 and of the pitman 104, which are spread apart so as to permit the forcible introduction of the slat between the converging webs 100. The webs 100 thus display a resilient latching action onto the slat and assist the tongues 120 to prevent undesirable slat rattle. Once the slat has been placed in the slat carriers, the pitman 104 is latched to the tooth 119 of the portion 118, thus snappingly latching the arm 106 in the recess 101. The arm 106 is cylindrical for this reason and is forcibly introduced through the groove 108: the latter has a width less than the diameter of the arm 106 (FIGS. 15 and 17).

The displacement of the arm 106 into 101 can be carried out by virtue of the elasticity of the arm 105 which finds a seat in the notch 102 and is retained in position by the shoulder 103, the latter being engaged by the recess 107.

By so doing, the pitman 104 is positively latched in position in every direction and is fastened to the portion 118. It is thus apparent that the slat 116, when urged by a force directed in the direction of the arrow $F_1$ (FIG. 17), cannot, in any way, come out of the slat carrier since it is blocked by the teeth 119 which are retained positively on the sliding plane of the slat by the agency of the pitman 104 which prevents the bending of the flexible portion 118.

The slats are thus prevented from coming out of the carriers and cannot drop out of the window so that serious accidents and injuries to passers-by are concurrently prevented.

Figure 16:
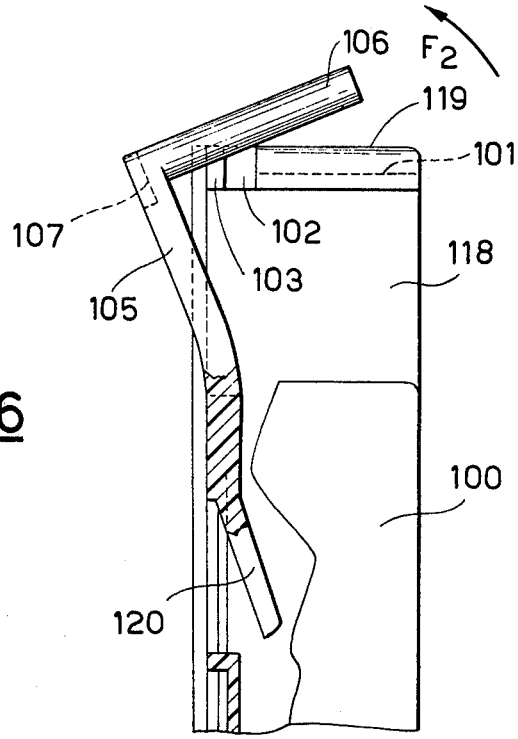
FIG. 16 is an elevational view, partly in cross-section, which shows the slat carrier in the position in which the slat is being withdrawn.

If necessary, the slats can easily be removed from their carriers by first withdrawing the pitman 104 from the tooth 119, manually pulling with sufficient force the arm 106 in the direction of arrow $F_2$ of FIG. 16. The slat can easily be withdrawn from its carriers by spreading out the portions 118 and the pitmans 104.

A further interesting feature is the two recesses 109 formed through the outer surface of the core of the profile 117, these recesses being capable of receiving any gasket for providing a seal against weathering agents, especially rain. Such gaskets (not shown) display a sealing action between the uprights and the slat carriers.

While a possible embodiment of the invention has been shown and described herein, it will be understood that modifications and changes can be introduced therein without departing from the scope of the invention. For example, the snapping engagement between the lever and the upright can be different from the embodiment shown herein, as well as the number of crenellations in the toothed sector of the lever could be different.

The scope of the invention is thus defined in and by the claims appended hereto.

I claim:

1. A swingable-slat window of the type including a window frame, a plurality of slat carriers pivotally mounted at intermediate points on said window frame, a control rod disposed parallel to one side of said window frame and having a pivotal connection with each of said slat carriers, a control lever pivotally mounted on said window frame adjacent said control rod, a connecting rod having one end pivotally connected to said control rod and the opposite end pivotally connected to said control lever for positioning said control rod in accordance with the position of said control lever; characterized in that said control lever has means fixedly forming a part thereof in resilient snapping engagement with means on said window frame.

2. A swingable-slat window according to claim 1 wherein said control lever is of an integral one piece construction.

3. A swingable-slat window according to claim 1 wherein there is a brace secured to said window frame and forming means effecting said pivotal mounting of said control lever, said control lever having a bifurcated end engaged over a central projection of said brace, and said means fixedly forming a part thereof being crenellated sectors on said bifurcated end.

4. A swingable-slat window according to claim 1 wherein there is a brace secured to said window frame and forming means effecting said pivotal mounting of said control lever, said control lever having a bifurcated end engaged over a central projection of said brace, and said means fixedly forming a part thereof being crenellated sectors on said bifurcated end, and said brace having resilient seats for said crenellated sectors on opposite sides of said central projection.

5. A swingable-slat window according to claim 1 wherein there is a brace secured to said window frame and forming means effecting said pivotal mounting of said control lever, said brace having mounting end portions secured to said window frame, a central projection extending between said mounting end portions and pivotally carrying said control lever, and said means on said window frame in snapping engagement with said control lever being a tie extending between said mounting end portions and extending alongside said central projection.

6. Window frame according to claim 1, characterized in that pins extend from the slat carriers, said pins snappingly engaging a bushing which, in its turn, is snappingly engaged by the window frame itself.

7. Window frame according to claim 1 characterized in that the pivotal connections of the control rod to the slat carriers, and of the connecting rod to the control lever are made by pins which are snappingly coupled to axially bored bushings.

8. Window frame according to claim 1, characterized in that said means for mutual snapping engagement between the lever and the window frame are composed by at least one crenellated sector provided at one end of said control lever, the crenellations engaging a corresponding yielding seat belonging to a brace removably fastened to the window frame and to which said lever is pivotally connected in correspondence with said crenellated sector.

9. Window frame according to claim 8, characterized in that said brace is removably fastened to the window frame by a bayonet coupling.

10. Window frame according to claim 8, characterized in that said sectors are two and engage two corresponding seats on separated ties on said brace.

11. Window frame according to claim 8, characterized in that said lever is pivoted to an ear of said brace with a forked end having a pair of said crenellated sectors which acts upon respective seats having the form of notches formed in an intermediate point of two ties freely resting on the frame and housed at their ends, laterally of said ear, within recesses formed through said brace.

12. Window frame according to claim 8, characterized in that said yielding seat is formed at an intermediate point of an elongated generally flat tie provided on said brace.

13. Window frame according to claim 12, characterized in that said tie is made of plastics material and is reinforced by a piano wire.

14. Window frame according to claim 8, characterized in that said seat is a notch formed at an intermediate point of a tie freely resting on the frame and housed at its ends in recesses formed in the brace.

15. Window frame according to claim 14, characterized in that said tie is reinforced by a piano wire.

16. Window frame according to claim 1, characterized in that said slat carriers are formed by channel sections including a care with staggered webs carrying slat retaining teeth perpendicularly to said webs.

17. Window frame according to claim 16, characterized in that the channel core has resiliently yieldable tongues extending inward therefrom.

18. Window frame according to claim 16, characterized in that at least one of said teeth has a removable anchoring means for a pitman, said means extending from the body of the channel section.

19. Window frame according to claim 18, characterized in that said anchoring means is a longitudinal recess formed in the tooth in which a portion of said pitman is snappingly engaged.

20. Window frame according to claim 19, characterized in that the webs of the channel section diverge from one another.

21. Window frame according to claim 19, characterized in that two recesses adapted to receive sealing gaskets are formed on the outer surface of the channel core.

22. Window frame according to claim 19, characterized in that said pitman has the shape of a bell-crank lever which is resiliently bendable, an arm of the bell crank lever being the portion which engages said recess in the tooth.

23. Window frame according to claim 22, characterized in that said bell-crank lever extends from the channel body on a plane which diverges relative to the plane on which said recess lies.

24. Window frame according to claim 22, characterized in that the other arm of the beel-crank pitman is engaged by a notch formed on the tooth.

* * * * *